United States Patent [19]

Baysinger et al.

[11] 3,975,136

[45] Aug. 17, 1976

[54] BURNER CONTROL SYSTEM

[75] Inventors: Robert L. Baysinger, St. Louis; Harry E. Newport, Jr., Crestwood, both of Mo.

[73] Assignee: Emerson Electric Co., St. Louis, Mo.

[22] Filed: July 28, 1975

[21] Appl. No.: 599,898

[52] U.S. Cl. ..... 431/74; 431/27; 431/66

[51] Int. Cl.[2] ..... F23N 5/00

[58] Field of Search ..... 431/66, 69, 71, 72, 431/27, 74, 78; 307/127, 117

[56] References Cited

UNITED STATES PATENTS

| | | | |
|---|---|---|---|
| 3,270,800 | 9/1966 | Deziel et al. | 431/69 |
| 3,832,123 | 8/1974 | Walbridge | 431/78 |
| 3,847,533 | 12/1974 | Riordan | 431/78 |
| 3,872,320 | 3/1975 | Juskewicz | 431/69 X |

*Primary Examiner*—Edward G. Favors
*Attorney, Agent, or Firm*—Paul A. Becker, Sr.

[57] ABSTRACT

A spark ignition circuit begins producing sparking pulses and a storage capacitor begins charging upon closure of a space thermostat. An electromagnetically operated valve controlling gas flow to a burner is energized sufficiently to open only upon discharge of the capacitor and a parallel holding circuit holds open the valve and prevents recharging of the capacitor.

A counting circuit, including a first monostable multivibrator, responds to each sparking pulse to effect incremental charging of a capacitor. Circuit means, including a programmable unijunction transistor and a second monostable multivibrator, responds to each occurrence of a predetermined charge on the capacitor to produce an output pulse comprising negative and positive signal voltages occurring in that order. Switching means responding to the positive signal of the first occurring output pulse effects the discharge of the storage capacitor and completion of the holding circuit, whereby the valve is open. If timely ignition occurs, means responding to burner flame cuts off igniter operation. If ignition does not occur within the following counting period, the switching means responds to the negative signal of the succeeding output pulse to break the valve holding circuit.

11 Claims, 3 Drawing Figures

BURNER CONTROL SYSTEM

This invention relates to automatic control systems for the safe operation of fluid fuel burners and particularly to an electronic control system in which a spark igniter directly ignites a main burner and in which proper functioning of the spark igniter, the electronic circuit components, and trial ignition period timing means is proven prior to the admission of fuel flow to the burner.

In burner control systems wherein a main burner is directly ignited by spark ignition, a trial ignition period is provided during which fuel is supplied to the burner and the spark igniter is operated. If at the termination of this period combustion has not occurred, the fuel supply is cut off, or if combustion has occurred during this period, the fuel supply is continued. In the operation of gas burners, particularly under conditions in which hazardous accumulations of gas would occur in a very short time if combustion does not occur, it is obviously essential in the interest of safety to reduce the trial period to a practical minimum in the order of 10 seconds or less.

When shortening the trial period to 10 seconds or less, the reliability and accuracy of the timing means becomes highly important. The thermal time switches employing bimetal elements widely employed in the past to provide such trial periods are influenced by variations in supply voltage and ambient temperature, which may result in intolerable variations in the trial period when the required time period is extremely short. Electronic timing circuits, while providing the required accuracy for extremely short trial periods, usually include capacitors and solid state components, the malfunctioning of any of which may result in an unsafe condition. It is essential, therefore, when employing timing circuits of this kind that the arrangement be such that proper functioning of the means providing the trial period be proven functionally prior to admission of fuel flow to the burner each time the burner is operated.

It is an object of this invention to provide a generally new and improved electrical control system for a main burner directly ignited by spark ignition means having novel means providing a relatively short and accurate ignition trial period.

A further object is to provide an electrical control system for fluid fuel burners having spark ignition means for directly igniting a main burner and means providing an ignition trial period in which functioning of the spark ignition means and the means providing the ignition trial period is proven prior to initiation of the ignition trial period.

A further object is to provide an electrical control system for fluid fuel burners having spark ignition means operative to produce sparking pulses at a relatively constant frequency, means operative to provide an ignition trial period during which the spark ignition means is operated and fuel is supplied to a burner, including a digital counting circuit operative to count the sparking pulses, and circuit means operative in response to the occurrence of a finite number of sparking pulses to initiate the ignition trial period and operative in response to the succeeding occurrence of the same number of pulses to terminate the trial period in event ignition has not occurred, and means responsive to burner flame to cut off operation of the spark ignition means.

More specifically, it is an object to provide an electrical control system for fluid fuel burners having spark ignition means operative to produce sparking pulses at a relative constant frequency, a digital counting circuit responsive to each sparking pulse to effect incremental charging of a capacitor, circuit means operative in response to each occurrence of a predetermined charge on the capacitor to produce an output pulse comprising negative and positive signals occurring in that order, switching means responsive to the positive voltage signal of the first occurring output pulse to effect the opening of an electromagnetically operated fuel valve and responsive to the negative voltage signal of the succeeding output pulse to effect closing of the fuel valve, and means responsive to burner flame to cut off operation of the spark ignition means.

Further objects and advantages will appear from the following description when read in connection with the accompanying drawings.

Figure 1:
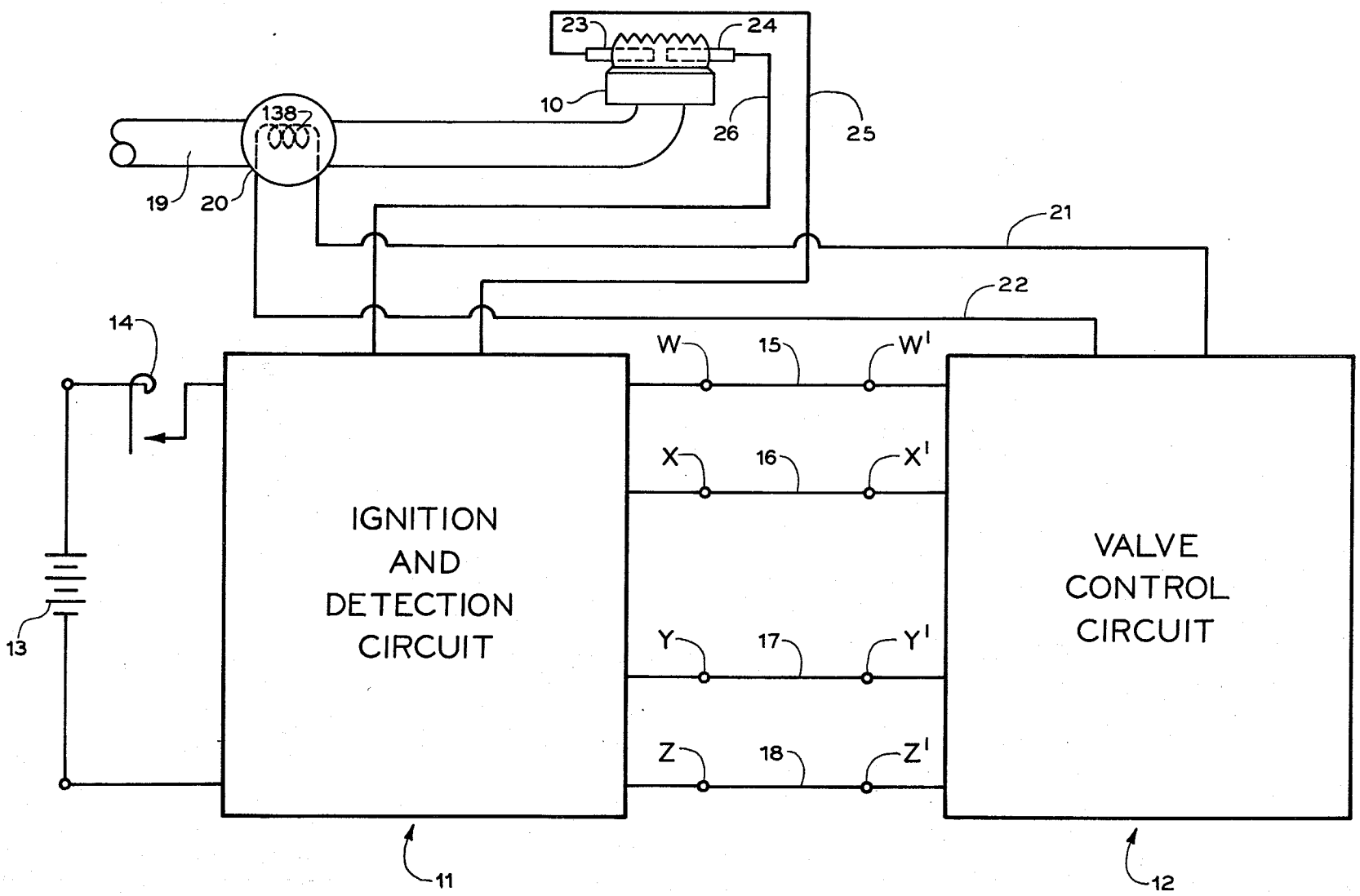
FIG. 1 is a diagrammatic illustration of a burner control system constructed in accordance with the present invention.

Referring to the drawings in more detail, FIG. 1 illustrates an electrically energizable control system including a gas burner 10, an ignition and detection circuit 11, and a valve control circuit 12. The ignition and detection circuit 11 and the valve control circuit 12 are shown diagrammatically in detail in FIG. 2 and FIG. 3, respectively. The output terminals W, X, Y, and Z of the ignition and detection circuit 11 are connected to input terminals W′, X′, Y′, and Z′ of the valve control circuit 12 by leads 15, 16, 17, and 18, respectively.

The burner 10 is supplied with gas from a source through a supply conduit 19, having an electrically operated gas valve 20 therein connected to the valve control circuit 12 by leads 21 and 22. Spaced spark electrodes 23 and 24 are mounted adjacent burner 10 for purposes of igniting the burner and to detect the presence of flame. Spark electrodes 23 and 24 are connected by leads 25 and 26 to the ignition and detection circuit 11.

IGNITION AND DETECTION CIRCUIT

Figure 2:
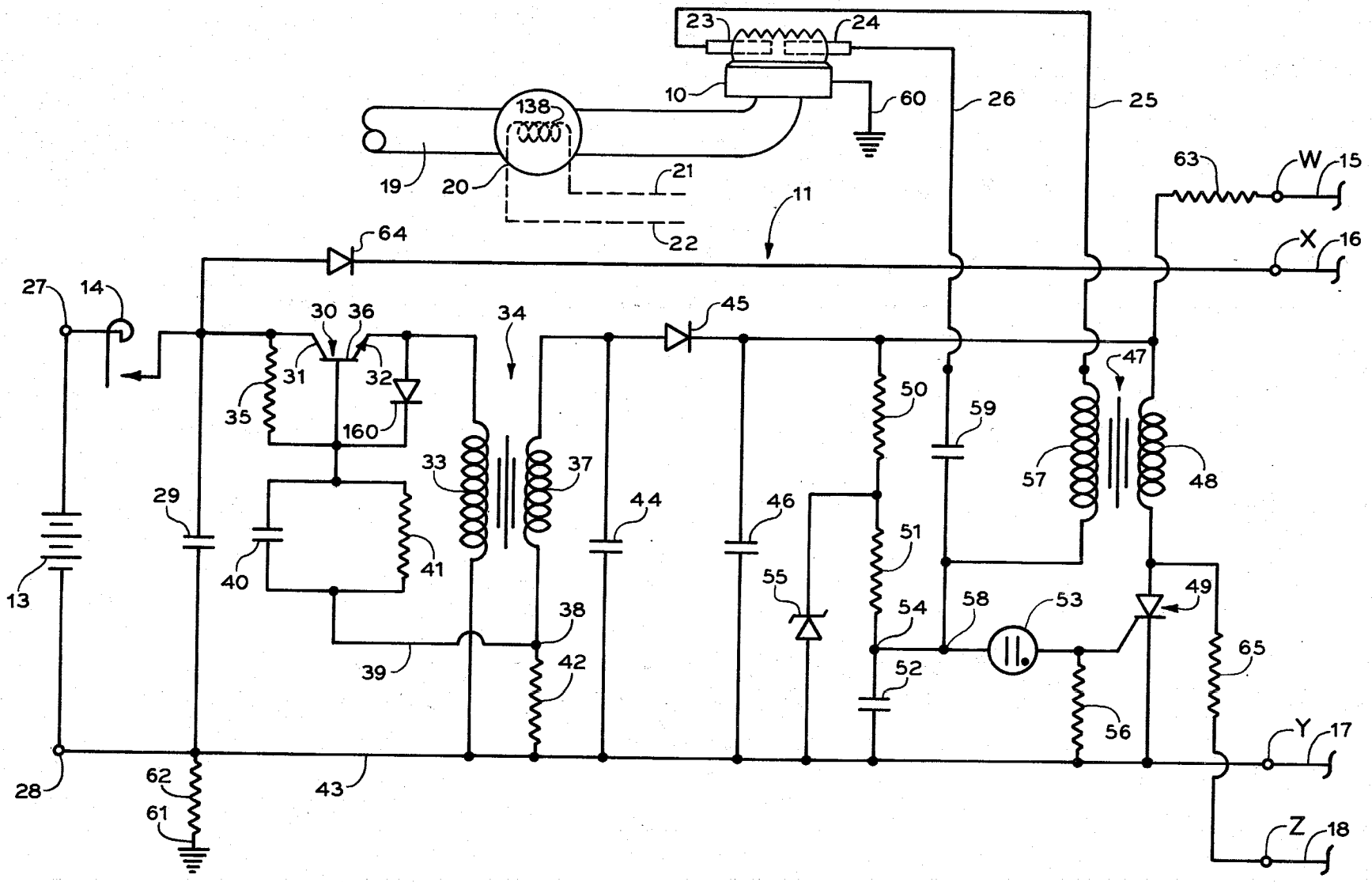
FIG. 2 is a detailed electrical circuit diagram of the ignition and detection circuit portion of the system shown in FIG. 1.

Referring now to FIG. 2, the ignition and detection circuit 11 is connected to terminals 27 and 28 of a 12-volt storage battery 13 through a thermostat 14. A capacitor 19 is connected across the source 13 through thermostat 14 to stabilize voltage input to the ignition and detection circuit 11.

An NPN transistor 30 has its collector 31 connected to terminal 27 thorugh termostat 14 and its emitter 32 connected to terminal 28 through the primary winding 33 of a coupling transformer 34. A resistor 35 connected between the collector 31 and the base 36 of transistor 30 applies a limited forward bias which is sufficient to initiate conduction through transistor 30 when thermostat 14 is closed.

The secondary winding 37 of coupling transformer 34 is connected at its lower end at a point 38 to the base 36 of transistor 30 by a lead 39 and through a capacitor 40 and a parallel connected resistor 41. The lower end of secondary winding 37 is also connected to terminal 28 through a voltage dividing resistor 42 and a lead 43. The upper end of secondary winding 37 is connected to terminal 28 through a small capacitor 44 and the lead 43. The upper end of secondary winding 37 is also connected to terminal 28 through a diode 45, a storage capacitor 46, and the lead 43.

An ignition transformer 47 has its primary winding 48 connected across the storage capacitor 46 through an SCR 49. Gating means for SCR 49 comprises resistors 50 and 51 and a capacitor 52 series connected across the storage capacitor 46, and a triggering neon bulb 53 connected between the SCR gate electrode and a point 54 between resistor 51 and capacitor 52. The resistors 50 and 51 are connected between the SCR gate electrode and the anode side thereof. A Zener diode 55 is connected across resistor 51 and capacitor 52 to limit the voltage that can be applied to capacitor 52. A resistor 56 is connected between the gate electrode and the cathode of SCR 49 to shunt any leakage currents and thus prevent SCR 49 from turning on due to leakage current.

The secondary winding 57 of the ignition transformer 47 is connected at one end to a point 58 in the gating means of SCR 49 between neon bulb 53 and point 54. This end of secondary winding 57 is connected through a d. c. blocking capacitor 59 to one of the spark electrodes 24 through lead 26. The other end of the secondary winding 57 is connected by the lead 25 to the other spark electrode 23. Spark electrodes 23 and 24 are spaced with respect to each other such that a suitable spark gap is provided across which sparking will occur. Also, the spark electrodes 23 and 24 are positioned sufficiently close to the metal burner 10 so that the gap therebetween will be bridged by flame when the fuel from burner 10 is ignited. The burner 10 is grounded at 60 and the ignition and detection circuit 11 is grounded at 61 through a resistor 62.

Output terminal W is connected to one end of the primary winding 48 of the ignition transformer 47 through a high impedance resistor 63. Output terminal X is connected to source terminal 27 through a diode 64 and the thermostat 14. Output terminal Y is connected to source terminal 28 through the lead 43. Output terminal Z is connected to the other end of the primary winding 48 through a resistor 65.

VALVE CONTROL CIRCUIT

Figure 3:
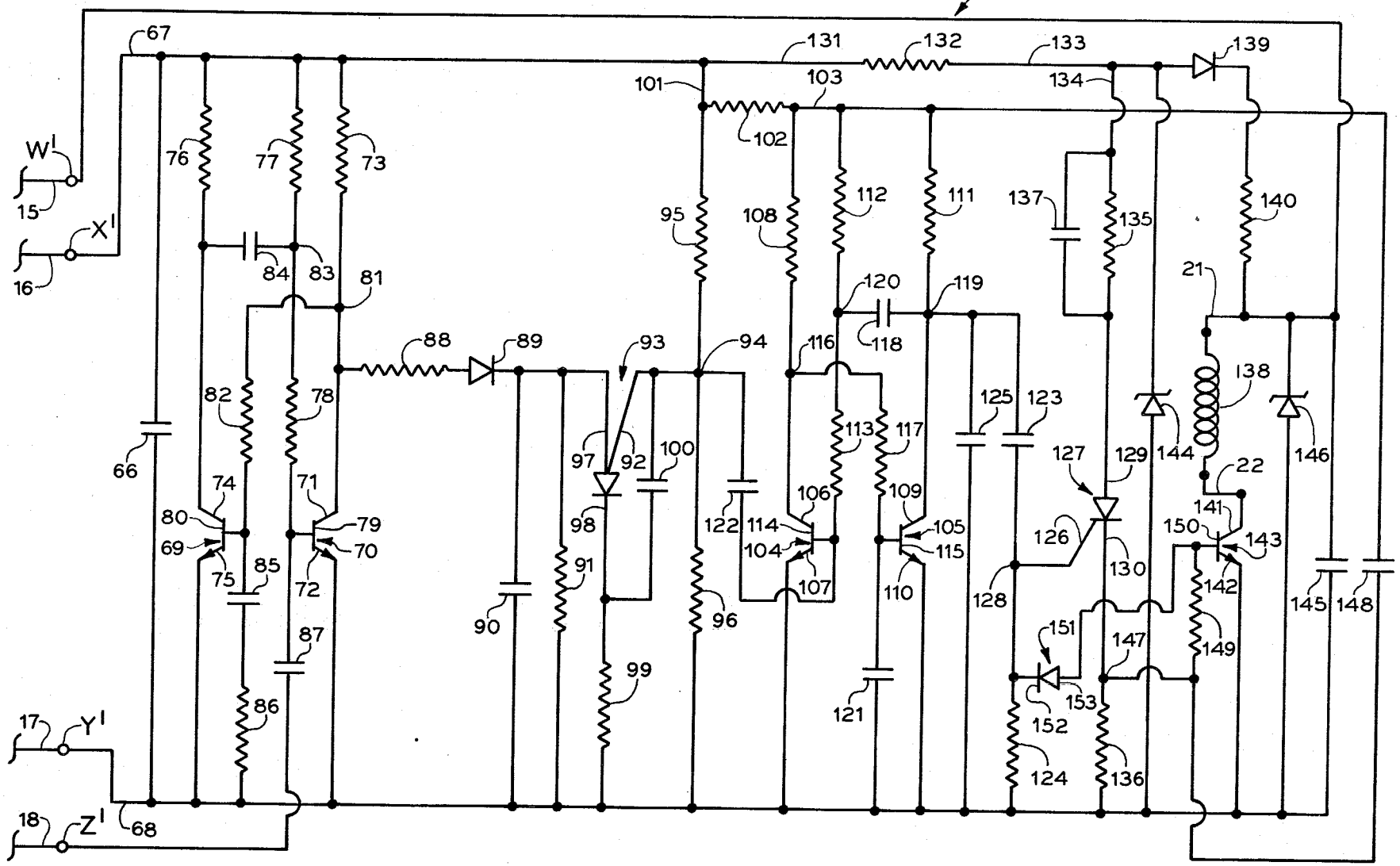
FIG. 3 is a detailed electrical circuit diagram of the valve control circuit portion of the system shown in FIG. 1.

Referring now to FIG. 3, the valve control circuit 12 includes input terminals W′, X′, Y′, and Z′, which are connected to the outut terminals W, X, Y, and Z of the ignition and detection circuit 11 by any suitable means such as by the leads 15, 16, 17, and 18, as shown in FIG. 1. A capacitor 66 to stabilize voltage input to the valve control circuit 12 is connected across terminals X′ and Y′ through leads 67 and 68 and thus to terminal 27 of the power source 13 through lead 16, the diode 64, and the thermostat 14, and to terminal 28 through leads 17 and 43.

A first monostable multivibrator is connected across terminals X′ and Y′ and includes NPN transistors 69 and 70. Connected in series with collector 71 and the emitter 72 of transistor 70 across terminals X′ and Y′ is a resistor 73. Connected in series with the collector 74 and the emitter 75 of transistor 69 across terminals X′ and Y′ is a resistor 76. Resistors 77 and 78 are connected in series between terminal X′ and the base 79 of transistor 70. Connected between the base 80 of transistor 69 and a point 81 between resistor 73 and the collector 71 of transistor 70 is a resistor 82. Connected between the collector 74 of transistor 69 and a point 83 between resistors 77 and 78 is a timing capacitor 84. The base 80 of transistor 69 is connected to terminal Y′ through a capacitor 85, a resistor 86, and lead 68. The base 79 of transistor 70 is connected to terminal Z′ through a coupling capacitor 87.

In the absence of a signal from terminal Z′ through coupling capacitor 87, transistor 70 is biased on so that the voltage potential at point 81 is at the relatively low potential of terminal Y′ plus the small voltage drop across the conducting transistor 70. Since the base 80 of transistor 69 is coupled to point 81 through resistor 82, transistor 69 is off when transistor 70 is on. When a negative signal is applied to the base 79 of transistor 70 through the coupling capacitor 87, transistor 70 is turned off. The voltage potential at point 81 thus becomes more positive, causing transistor 69 to be biased on. Transistor 69 being on enables capacitor 84 to charge through resistor 77. When the voltage potential at point 83 due to the charging of capacitor 84 becomes sufficiently positive, transistor 70 is again biased on and transistor 69 is shut off. Thus, a digital signal appears at the point 81, the signal having a relatively low voltage potential when the transistor 70 is on and a relatively high voltage potential when the transistor 70 is off.

Connected between the point 81 and terminal Y′ through a resistor 88, a diode 89, and lead 68 is a timing capacitor 90. Capacitor 90 is charged by the relatively high voltage potential portions of the digital signals that appear at the point 81. Diode 89 prevents capacitor 90 from discharging when the relatively low potential portions of the digital signals appear at point 81. A bleed resistor 91 connected across the capacitor 90 prevents rapid discharging of the capacitor 90 when the relatively low voltage potential portions appear at the point 81 but allows the capacitor 90 to discharge in the prolonged absence of digital signals.

The gate electrode 92 of a programmable unijunction transistor (PUT) 93 is connected to a point 94 between voltage dividing resistors 95 and 96 which are series connected through leads 67 and 69 across terminals X′ and Y′. The anode 97 and cathode 98 of PUT 93 are connected in series with a current limiting resistor 99, and the series connection is connected in parallel with capacitor 90. A filter capacitor 100 is connected between the gate 92 and the cathode 98 to prevent the PUT 93 from firing due to transients.

Capacitor 90 is incrementally charged by the digital signals generated at the point 81. When the voltage on capacitor 90, which is also the voltage on the anode 97 of the PUT 93, becomes approximately 0.6 volts more positive than the voltage on the gate 92, the PUT 93 fires. The time required to effect the firing of the PUT 93 can readily be factory adjusted by selecting the proper values of the resistors 95 and 96 which determine the voltage on the gate 92, and by selecting the proper values of the circuit components which determine the time required for the anode 97 to become 0.6 volts more positive than the gate 92, such circuit components including resistor 77 and capacitor 84. It should be noted that once these values have been selected, the time required to effect the firing of the PUT 93 is independent of variations in the voltage potential across terminals X′ and Y′ since the circuit components determining the digital signals generated at the point 81 and the circuit components determining the voltage on the gate 92 are both connected across terminals X′ and Y′.

A second monostable multivibrator, connected across terminals X′ and Y′ through lead 67, a lead 101, a resistor 102, a lead 103, and lead 68, includes NPN transistors 104 and 105. Connected in series with the collector 106 and emitter 107 of transistor 104 between leads 103 and lead 68 is a resistor 108. Connected in series with the collector 109 and emitter 110 of transistor 105 between lead 103 and lead 68 is a resistor 111. Resistors 112 and 113 are connected in series between lead 103 and the base 114 of transistor 104. Connected between the base 115 of transistor 105 and a point 116 between resistor 108 and the collector 106 of transistor 104 is a resistor 117. A capacitor 118 is connected between a point 119 at the collector 109 of transistor 105 and point 120 between resistors 112 and 113. The base 114 of transistor 104 is connected to the point 94 between resistors 95 and 96 through a coupling capacitor 122.

In the absence of a signal from the gate 92 of the PUT 93 through the coupling capacitor 122, transistor 104 is biased on and transistor 105 is off. When transistor 105 is off, the voltage potential at point 119 is relatively high. When the PUT 93 fires, it avalanches on, causing a negative going signal on the gate 92. This negative going signal, coupled to the base 114 of transistor 104 by the coupling capacitor 122, biases transistor 104 off. Transistor 104 being off enables the voltage potential at point 116 to effect the turn on of transistor 105. When transistor 105 is on, the voltage potential at point 119 is at the potential of terminal Y′ plus the small voltage drop across the conducting transistor 105. Transistor 105 being on enables capacitor 118 to charge through resistor 112. When the voltage potential at point 120 due to the charging of capacitor 118 becomes sufficiently positive, transistor 104 is again biased on and transistor 105 is shut off. Thus a digital appears at point 119, the signal having a relatively high voltage potential when transistor 105 is off and a relatively low voltage potential when transistor 105 is on.

Connected in parallel with the collector 109 and emitter 110 of transistor 105 is a capacitor 123 and a series connected resistor 124. A filter capacitor 125 is also connected in parallel with the collector 109 and emitter 110 of transistor 105. The gate electrode 126 of a silicon-controlled rectifier (SCR) 127 is connected to a point 128 between capacitor 123 and resistor 124. The anode 129 and the cathode 130 are connected across terminals X′ and Y′ through lead 67, a lead 131, a resistor 132, a lead 133, a lead 134, a resistor 135, a resistor 136, and lead 68. A filter capacitor 137 is connected in parallel with resistor 135.

A valve actuating means such as a solenoid winding 138 is energized in one operative condition to a first higher level to effect opening of valve 20 from its biased closed position and is energized in another operative condition to a second lower level wherein it is capable of holding valve 20 open, but is incapable of opening it. To energize winding 138 at the second lower level, it is connected across power source terminals 27 and 28 through thermostat 14, diode 64, terminals X and x′, leads 67 and 131, resistor 132, lead 133, diode 139, resistors 140, leads 21 and 22, and NPN transistor 143, lead 68, terminals Y and Y′, and lead 43. The resistor 140 connected in series with winding 138 and a Zener diode 144 connected in parallel with the winding limit energization of the winding to that level which will hold valve 20 open but will not open it.

To momentarily energize winding 138 at the first higher level, a storage capacitor 145 is provided and connected in parallel with winding 138 and transistor 140. When capacitor 145 is charged sufficiently to a voltage determined by a parallel connected Zener diode 146 and then discharged through winding 138, the winding will be momentarily energized at the first higher level and effect opening of valve 20.

The storage capacitor 145 is connected across power source terminals 27 and 28 through thermostat 14, diode 64, terminals X and X′, leads 67 and 131, resistor 132, lead 133, diode 139, resistor 14, lead 68, terminals Y and Y′, and lead 43, and will therefore begin charging upon closure of thermostat 14. The charge which it will attain through this connection is, however, limited by parallel Zener diode 144 to a value which is insufficient upon discharge to effect the momentary energization of winding 138 to the first higher level. To attain sufficient charging of capacitor 145 to effect, upon discharge, the opening of valve 20, it is also connected to the secondary coil 37 of the ignition circuit through resistor 63 and diode 45. The diode 139 permits charging capacitor 145 to this higher voltage.

When transistor 143 is conducting, the impedance of solenoid winding 138 is sufficiently low to prevent charging of the parallel connected capacitor 145 to a value which upon discharge would effect opening of valve 20.

Connected between lead 103 and the cathode 130 of SCR 127 at a point 147 is a capacitor 148. Upon initial energizing of the system through thermostat 14, capacitor 148 is effective to make the cathode 130 of SCR 127 sufficiently more positive than the gate 126 so that SCR 127 is off.

A resistor 149 is connected between the cathode 130 of SCR 127 and the base 150 of transistor 143 to limit the base emitter current through transistor 143. A diode 151 has its cathode 152 connected to the gate 126 of SCR 127 at point 128 and its anode 153 connected to the base 150 of transistor 143. As will be shown hereinafter, diode 151 effects the shutoff of SCR 127.

OPERATION

Referring to FIG. 2, when the thermostat 14 closes in response to a drop in the temperature of the space being heated by burner 10, a limited forward starting bias is applied to the base 36 of transistor 30 through resistor 35 to initiate conduction through the collector 31 and emitter 32 of transistor 30 and primary winding 33 of transformer 34. This initial current flow through primary winding 33 induces a voltage in the secondary winding 37. This induced voltage is of such polarity that the lower end of secondary winding 37 is positive, causing current to flow through capacitor 40, causing it to charge, and through the parallel resistor 41 and the base 36 and emitter 32, thereby effecting an increased current flow through the collector 31 and emitter 32 of transistor 30 and through primary winding 33. Regenerative feedback therefore occurs, and the transistor 30 is rapidly driven to saturation.

During this period of increasing current flow through transistor 30 and primary winding 33, capacitor 40 is charged by the induced voltage in secondary winding 37. Secondary winding 37 has a considerably greater number of turns that the primary winding 33, so that the voltage induced in the secondary winding 37 when transistor 30 approaches saturation is considerably greater than the supply voltage across terminals 27 and 28. When saturation of transistor 30 occurs and current flow through primary winding 33 ceases to increase, the induced voltage in secondary winding 37 drops to zero and its field collapses. As a result, a pulse of opposite polarity is induced across secondary winding 37 and capacitor 40 now discharges. The collapse off the field around secondary winding 37 and the discharge of capacitor 40 reverse biases transistor 30 and abruptly cuts it off at maximum current flow. The cutoff of transistor 30 at saturation causes the field around primary winding 33 to collapse and, by mutual induction, causes a high voltage pulse to appear across secondary winding 37 of the same polarity as the pulse induced therein upon collapse of its own field.

The mutually induced high voltage pulse in secondary winding 37 now charges capacitor 40 in an opposite direction through a diode 160 and also charges small capacitor 44. This high voltage pulse also provides an increment of charge through diode 45 to the storage capacitor 46, to capacitor 52 through resistors 50 and 51, and to energy storage capacitor 145, see FIG. 3, through resistor 63. As this high voltage pulse decreases, small capacitor 44 and capacitor 40 now discharge to again forward bias transistor 30 to start another cycle. The values of the circuit components, such as coupling capacitor 40, resistor 41, and small capacitor 44, are such that the circuit oscillates at approximately 250 kilocycles per second.

When the storage capacitor 46 attains a predetermined charge, capacitor 52 will already have become sufficiently charged through resistors 50 and 51 to permit the application of a breakdown voltage across neon bulb 53. When neon bulb 53 fires and conducts, SCR 49 is gated on and the storage capacitor 46 discharges through the primary winding 48 of ignition transformer 47. This induces a high voltage pulse in secondary winding 57, causing a spark to occur across the spark gap between spark electrodes 23 and 24. The igniter transformer 47 is a voltage step-up transformer, the secondary winding 57 having many more turns than the primary winding 48.

Upon discharge of storage capacitor 46, neon bulb 53 again becomes non-conductive, and the swing of the storage capacitor 46 following its discharge cuts off conduction through the SCR 49. However, with SCR 49 off, the negative pulse in this swing of the storage capacitor 46 is transmitted through resistor 65 to terminal Z for a reason to be hereinafter described.

The time constants of capacitors 46 and 52 are preferably selected so that the storage capcitor 46 discharges through primary winding 48 approximately 2 times per second. Therefore, sparking occurs at the spark electrodes 23 and 24 2 times per second and a negative pulse appears at terminal Z 2 times per second.

Referring now to FIGS. 2 and 3, when thermostat 14 is first closed, input terminal X′ is connected to terminal 27 of the power source 13 through lead 16, diode 64, and the thermostat 14 and input terminal Y′ is connected to terminal 28 of the power source 13 through leads 17 and 43. Transistor 70 in the first monostable multivibrator is biased on through resistors, 76, 77, 78, and capacitor 84. With transistor 70 on, the voltage potential at the point 81 is at the relatively low potential of terminal Y′ plus the small voltage drop across the conducting transistor 70, and is insufficient to cause the diode 89 to conduct.

Concurrently energized when the thermostat 14 is first closed is the voltage dividing network comprising resistors 95 and 96. Since the gate 92 of the PUT 93 is connected to the point 94 between resistors 95 and 96, the relative values of resistors 95 and 96 establish the firing voltage of the PUT 93.

Also concurrently energized is the second monostable multivibrator wherein transistor 104 is biased on through lead 101, resistors 102, 111, 112, 113, and capacitor 118.

Also concurrently energized when thermostat 14 is first closed are capacitors 148, 123, and filter capacitor 125. Capacitor 148 is connected between lead 103 and lead 68 through a resistor 136 and is connected to the cathode 130 of SCR 127 at the point 147. Capacitor 123 is connected between lead 103 and lead 68 through a resistor 111 and a resistor 124 and is connected to the gate 126 of SCR 127 at the point 128. The time constants of the charging circuits for capacitors 148 and 123 are such that, as they are charging, gate 126 is prevented from becoming more positive than the cathode 130 so that SCR 127 is biased off. Since capacitor 148 is also series connected with the base 150 and emitter 142 of transistor 143 through resistor 149, transistor 143 is turned on. However, transistor 143 is only on for a very short time, determined by the time constant of the charging circuit for capacitor 148, and does not result in the valve coil 138 being sufficiently energized to effect the pull in of valve 20, which will be herinafter described.

Also concurrently energized when thermostat 14 is first closed is the storage capacitor 145. Capacitor 145 is connected across terminals X′ and Y′ through leads 67 and 131, resistor 132, lead 133, diode 139, resistor 140, and lead 68. The time constant of this charging circuit is such that, when transistor 143 is off, capacitor 145 rapidly charges to a voltage limited by Zener diode 144. This voltage, because of resistor 132, is slightly below the voltage potential on terminals X′ and Y′ and is considerably less than the voltage to which capacitor 145 must be charged to offset the opening of valve 20 upon the discharge of capacitor 145 through valve coil 138. The necessary additional charge for capacitor 145 is obtained from the secondary winding 37 of the coupling transformer 34, see FIG. 2, and the voltage on capacitor 145 is limited by Zener diode 146. When the upper end of secondary winding 37 is positive, capacitor 145 is charged through a circuit as follows: from the upper end of secondary coil 37, diode 45, resistor 63, terminal W, lead 15, terminal W′, capacitor 145, lead 68, terminal Y′, lead 17, terminal Y, and resistor 42 to point 38 at the lower end of secondary coil 37. A parallel path with resistor 42 includes primary winding 33, diode 160, capacitor 40 and resistor 41, and lead 39. Primarily because of the high impendance value of resistor 63, it takes a relatively long time, approximately 4 seconds, to charge capacitor 145 to its required value. Diode 139 enables capacitor 145 to charge to the voltage limited by Zener diode 146, which voltage is higher than the voltage limited by Zener diode 144.

As heretofore described, the swing of the storage capacitor 46 following its discharge cuts off conduction through the SCR 49 and provides a negative pulse through resistor 65 to terminal Z. This negative pulse, coupled through resistor 65, lead 18, and capacitor 87 to the base 79 of transistor 70, causes transistor 70 to shut off and transistor 69 to turn on. When transistor 69 is on, capacitor 84 charges through resistor 77. When the voltage potential at 83 becomes sufficiently positive, transistor 70 is again biased on and transistor 69 shuts off. Thus, the length of time that transistor 70 is off is determined primarily by the time constant of capacitor 84 and resistor 77. It should be understood that this time constant could be adjustable by providing any convenient means to adjust the value of resistor 77. When transistor 70 is off, the voltage potential at 81 is sufficiently more positive to cause diode 89 to conduct so that capacitor 90 receives an incremental charge each time the transistor 70 is shut off. Capacitor 90 is incrementally charged in this manner until the voltage on capacitor 90, and thus on the anode 97 of PUT 93, is approximately 0.6 volts greater than the voltage on the gate 92. Thus, the time required to effect the firing of PUT 93 is dependent upon the frequency of the negative pulse and the amplitude and time duration of the digital signal at point 81 when transistor 70 is off. Since the amplitude of the voltage on the anode 92 and the amplitude and time duration of the digital signal at point 81 are both dependent upon the voltage potential between terminals X′ and Y′, the time required to effect the firing of the PUT 93 is independent of fluctuations in the voltage of the power source 13. In a preferred embodiment, wherein the storage capacitor 46 discharges 2 times per second as previously described, the values of the circuit components are preferably selected so that it requires six seconds to effect the firing of PUT 93.

The firing of PUT 93 effects the opening of valve 20 in a manner to be now described. During the time period prior to the firing of PUT 93, storage capacitor 145 was charged to the voltage necessary to effect the opening or pull in of valve 20. Capacitors 148 and 123 were quickly charged when the thermostat was first closed, effecting the shut off of SCR 127. Additionally, the charging of capacitor 148 through the base 150 and emitter 142 of transistor 143 was sufficiently rapid so that transistor 143 was on for only a brief portion of the time period prior to the firing of PUT 93 and thus was off for a sufficiently long time period to enable capacitor 145 to charge to its necessary value. When PUT 93 fires, it avalanches on so that the negative going signal due to the discharging of capacitor 90 appears at the anode 92 and the point 94 and is coupled by capacitor 122 to the base 114 of transistor 104, turning off transistor 104 and turning on transistor 105. The voltage potential at point 119 drops to the potential of terminal Y′ plus the small voltage drop across the conducting transistor 105. Capacitor 123 discharges through conducting transistor 105 thereby making the gate 126 of SCR 127 more negative than the cathode 130 and thus keeping SCR 127 off. When point 120 becomes sufficiently positive due to the charging of capacitor 118, transistor 104 is again biased on and transistor 105 shuts off. When transistor 105 shuts off, the relatively high positive voltage potential at point 119 appears at point 128 and thus on the gate 126 of SCR 127 through capacitor 123. Since the cathode 130 is at the low potential of terminal Y′, SCR 127 is gated on. SCR 127 then conducts through its anode 129 and cathode 130, through resistor 149, through the base 150 and emitter 142 of transistor 143, turning on transistor 143. When transistor 143 turns on, storage capacitor 145 discharges through valve coil 138 and the collector 141 and emitter 142 of transistor 143, causing valve coil 138 to be sufficiently energized to pull in valve 20. Transistor 143 remains turned on, and the valve coil 138 remains sufficiently energized to hold in the valve 20 through a circuit as follows: from terminal X′, leads 67 and 131, resistor 132, lead 133, diode 139, resistor 140, lead 21, valve coil 138, lead 22, transistor 143, lead 68, to terminal Y′.

Fuel now flows to burner 10 where ignition is attempted by the sparking between spark electrodes 23 and 24. During this trial ignition period, sparking continues at the rate of two sparks per second until ignition is achieved. Concurrently with the sparking at spark electrodes 23 and 24, the negative pulses due to the swing of the storage capacitor 46 are also occuring at the same frequency and incrementally charging capacitor 90.

If ignition does not occur within six seconds, capacitor 90 will again be sufficiently charged to effect the firing of PUT 93. As before, the firing of PUT 93 causes transistor 105 to turn on and enables capacitor 123 to discharge through the conducting transistor 105, causing a negative going signal to appear on the gate 126 of SCR 127. When the gate 126 becomes sufficiently more negative than the base 150 of transistor 143, diode 151 conducts and effects the turn off of transistor 143. With transistor 143 off and diode 151 conducting, the impedance of the circuit in series with the anode 129 and cathode 130 increases, thus reducing the current flow therethrough to a value below the holding value and effecting the shut off of SCR 127. When transistor 143 is turned off, valve coil 138 is de-energized causing the valve 20 to close. As soon as transistor 105 is again turned off, the relatively high positive voltage potential at point 119 again appears at point 128 and thus on the gate 126 of SCR 127 through capacitor 123, causing SCR 127 to again be gated on. Current then flows through SCR 127, resistor 149, and the base 150 and emitter 142, turning on transistor 143. However, transistor 143 was not off for a sufficiently long period of time to enable storage capacitor 145 to charge to the voltage necessary to cause pull in of valve 20. The system will remain in this lockout condition as long as the thermostat 14 is closed. That is, every 6 seconds transistor 143 will be shut off for a very short time and then immediately turned on again, thus preventing storage capacitor 145 from being charged to the voltage necessary to effect the opening of valve 20. Thus, the circuitry involved in achieving this lockout condition is the same circuitry previously used to enable valve 20 to open so that the ability of the lockout function to operate properly is proven whenever the trial ignition period is initiated.

If ignition does occur within 6 seconds after the gas valve 20 is opened, burner flame bridges the gap between electrodes 23 and 24 and burner 10, thereby considerably reducing the gap impedance between spark electrode 23 and burner 10. Leakoff from point 58 in the gating circuit of SCR 49 through secondary winding 57, lead 25, and across the gap between spark electrode 23 and burner 10 to ground is sufficient to prelude the charging of capacitor 52 through resistors 50 and 51 to the break-down voltage of neon bulb 53. Sparking between electrodes 23 and 24 will therefore cease when flame is present. Zener diode 55 further insures that the capicitor 52 will not be sufficiently charged to the break-down voltage of neon bulb 53, particularly in the event of an abnormal high voltage condition.

When gating of the SCR 49 is shunted by conduction through burner flame, the circuit will continue to oscillate, but with less power consumption. Under this condition, as the accumulated charge on the storage capacitor 46 approaches the voltage of the charging pulses from the secondary soil 37 through diode 45, the inductive and capacitive reactance will increase. Some of the charge applied to capacitor 46 will leak off through the flame. Also, under this condition, transistor 70, coupled to primary winding 48, is not affected since transistor 70 is responsive only to a negative signal.

While a preferred embodiment of the present invention has been illustrated and described in detail in the drawings and foregoing description, it will be recognized that many changes and modifications will occur to those skilled in the art. For example, the ignition and detection circuit 11 can be any of several different types energized by various voltages such as 12 volts, 24 volts, or 120 volts, the basic requirement being the capability of generating sparking at a relatively constant frequency. The valve coil 138 can be a relay coil having a set of contacts connecting the valve actuating means to a conventional power source. It is therefore intended, by the appended claims, to cover any such changes and modifications as fall within the true spirit and scope of the invention.

We claim:

1. In a conrol system for a fuel burner, a burner;

a source of electrical power;

an electrically operated valve for effecting the flow of fuel to said burner;

spark ignition means connected across said spark power source for producing sparking pulses at a relatively constant frequency;

an integrating capacitor charged in response to said sparking pulses;

circuit means operative in response to each occurrence of a predetermined charge on said capacitor to produce an output pulse comprising a first signal voltage of one polarity and a second signal voltage of opposite polarity;

switching means responsive to said second signal voltage of a first ocurring output pulse to effect opening of said valve and responsive to said first signal voltage of a succeeding output pulse to effect closing of said valve; and means responsive to burner ignition for terminating operation of said spark ignition means.

2. In a control system for a fuel burner, a burner;

a source of electrical power;

an electrically operated valve for effecting the flow of fuel of said burner;

spark ignition means connected across said power source for producing sparking pulses at a relatively constant frequency;

a capacitor;

circuit means, including a first monostable multivibrator, operative in response to said sparking pulses to effect charging of said capacitor;

circuit means, including a second monostable multivibrator, operative in response to each occurrence of a predetermined charge on said capacitor to produce an output pulse comprising a first signal voltage of one polarity and a second signal voltage of opposite polarity;

switching means responsive to said second signal voltage of a first occurring output pulse to effect opening of said valve and responsive to said first signal voltage of a succeeding output pulse to effect closing of said valve; and means responsive to burner ignition for terminating operation of said spark ignition means.

3. In a control system for a fuel burner, a burner;

a source of electrical power;

an electrically operated valve for effecting the flow of fuel to said burner;

spark ignition means connected across said power source for producing sparking pulses at a relatively constant frequency;

circuit means operative to count said sparking pulses and to produce an output pulse in response to each occurrence of a finite number of said sparking pulses;

said output pulse comprising a first signal voltage of one polarity and a second signal voltage of opposite polarity;

switching means responsive to said second signal voltage of a first occuring output pulse to effect opening of said valve and responsive to said first signal voltage of a succeeding output pulse to effect closing of said valve; and means responsive to burner ignition for terminating operation of said spark ignition means.

4. The control system claimed in claim 3 in which said circuit means includes an input circuit means, an intermediate circuit means, and an output circuit means;

said input circuit means being connected across said power source and to said ignition means and including means responsive to said sparking pulses for providing digital signals to said intermediate circuit means;

said intermediate circuit means including a capacitor and a thyristor device;

said capacitor being incrementally charged by said digital signals and effecting the firing of said thyristor device when said capacitor is charged to the firing voltage of said thyristor device; and said output circuit means being connected to said switching means and including means responsive to a signal produced by said firing of said thyristor device to provide said output pulse.

5. The control system claimed in claim 4 in which said means responsive to said sparking pulses includes a first monostable multivibrator circuit means having an input terminal connected to said ignition means and an output terminal connected through a diode to said capacitor.

6. The control system claimed in claim 4 in which said means responsive to a signal produced by said firing of said thyristor device includes a second monostable multivibrator circuit means.

7. The control system claimed in claim 4 in which said intermediate circuit means includes a bleed resistor connected across said timing capacitor for discharging said timing capacitor when operation of said spark ignition means is terminated.

8. The control system claimed in claim 4 in which said intermediate circuit means further includes a voltage dividing means connected across said power source; and said thyristor device is a programmable unijunction transistor having its gate connected to said voltage dividing means and its anode connected to said timing capacitor so that said firing of said transistor is independent of voltage fluctuations in said power source.

9. In a control system for a fuel burner, a burner;

a source of electrical power;

spark ignition means connected across said power source for producing sparking pulses at a relatively constant frequency;

means responsive to burner ignition for terminating operation of said spark ignition means;

an electrically operated valve for effecting the flow of fuel to said burner;

an electromagnetic winding for controlling operation of said valve;

switching means connected in series with said winding;

holding circuit means series connecting said winding and said switching means across said power source effective to holde said valve open but ineffective to open said valve;

pull-in circuit means connected to said ignition means effective to open said valve and including a storage capacitor;

said storage capacitor being connected in parallel with said series connected switching means and winding and operative in response to operation of said ignition means when said switching means is non-conductive for a predetermined time period to attain a sufficient charge for effecting opening of said valve; and circuit means connected to said power source, said ignition means, and said switching means operative to count said pulses and operative in response to each occurrence of a finite number of said pulses to produce an output pulse comprising a first portion for effecting non-conduction of said switching means and a second portion for effecting conduction of said switching means, and wherein a time perioid expended to count said finite number of sparking pulses is longer than said predetermined time period required for charging said storage capacitor so that said second portion of a first occurring output pulse is effective to open said valve, and wherein said second portion of said first occurring output pulse precludes said storage capacitor from attaining said sufficient charge so that said first portion of a succeeding output pulse which occurs if burner ignition has not occurred is effective to close said valve.

10. In a control system for a fuel burner, a burner;

a source of electrical power;

spark ignition means connected across said power source for producing sparking pulses at a relatively constant frequency;

means responsive to burner ignition for terminating operation of said spark ignition means;

an electrically operated valve for effecting the flow of fuel to said burner;

means including an electromagnetic winding for controlling operation of said valve;

said winding being responsive to a first level of energization effective to open said valve and a second level effective to hold said valve open but ineffective to open said valve;

controlled solid state switching means connected in series with said winding;

circuit means series connecting said switching means and said winding across said power source effective to provide said second level of energization;

a storage capacitor connected to said ignition means and in parallel with said series connected switching means and winding;

said storage capacitor being operative in response to operation of said ignition means to attain a sufficient charge when said switching means is non-conductive for a predetermined time period to provide, upon its discharge through said parallel connected winding, said first level of energization;

circuit means connected across said power source and to said ignition means and to the controlling electrode of said switching means;

said circuit means including an integrating capacitor incrementally charged in response to said sparking pulses and including means operative in response to a predetermined charge on said integrating capacitor to produce a first output pulse comprising negative and positive signal portions occurring in that order and, in the absence of burner ignition, operative in response to a reoccurrence of said predetermined charge to produce a succeeding output pulse also comprising negative and positive signal portions occurring in that order;

said controlling electrode of said switching means being responsive to said positive signal portion of said first output pulse to effect conduction whereby said valve is opened by said discharge of said storage capacitor; and said controlling electrode being responsive to said negative signal portion of said succeeding output pulse to effect non-conduction whereby said valve is closed, and being responsive to said positive signal portions of said first and succeeding output pulses to effect conduction whereby said storage capacitor is prevented from attaining said sufficient charge to provide said first level of energization.

11. The control system claimed in claim 10 including biasing circuit means connected to said controlling electrode operative to effect a sufficiently long time period of non-conduction of said switching means prior to the occurrence of said first output pulse so that said storage capacitor attains said sufficient charge.

* * * * *